US010787348B2

(12) United States Patent
Ariizumi

(10) Patent No.: US 10,787,348 B2
(45) Date of Patent: Sep. 29, 2020

(54) CHAIN BLOCK AND BUILT-IN COVER

(71) Applicant: KITO CORPORATION, Yamanashi (JP)

(72) Inventor: Ai Ariizumi, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 149 days.

(21) Appl. No.: 15/775,231

(22) PCT Filed: Nov. 10, 2016

(86) PCT No.: PCT/JP2016/083343
§ 371 (c)(1),
(2) Date: May 10, 2018

(87) PCT Pub. No.: WO2017/082336
PCT Pub. Date: May 18, 2017

(65) Prior Publication Data

US 2018/0265337 A1 Sep. 20, 2018

(30) Foreign Application Priority Data

Nov. 12, 2015 (JP) ..... 2015-221983

(51) Int. Cl.
*B66D 3/26* (2006.01)
*B66D 3/22* (2006.01)
*B66D 1/28* (2006.01)

(52) U.S. Cl.
CPC ..... *B66D 3/26* (2013.01); *B66D 1/28* (2013.01); *B66D 3/22* (2013.01)

(58) Field of Classification Search
CPC ..... B66D 3/26; B66D 1/28; B66D 3/22
See application file for complete search history.

(56) References Cited

U.S. PATENT DOCUMENTS 1,762,765 A * 6/1930 Davis ..... B66D 1/26 254/288
3,443,772 A * 5/1969 Prosser ..... B65H 75/425 242/390.8

(Continued)

FOREIGN PATENT DOCUMENTS

CN 201594467 U 9/2010
CN 201688106 U 12/2010

(Continued)

OTHER PUBLICATIONS

SIPO First Office Action corresponding to Application No. 201680062928.X; dated Feb. 1, 2019.

(Continued)

*Primary Examiner* — Sang K Kim
*Assistant Examiner* — Nathaniel L Adams
(74) *Attorney, Agent, or Firm* — Cantor Colburn LLP

(57) ABSTRACT

A chain block including: a gear unit including a pinion gear, and a load gear configured to rotate integrally with a load sheave member; a case body configured to house the gear unit and to be supplied with grease being semifluid or semisolid at a working temperature as a lubricant; and a built-in cover arranged inside the case body, wherein: the built-in cover includes a first peripheral wall part configured to cover an outer peripheral side of the pinion gear, and a second peripheral wall part provided to be larger in diameter than the first peripheral wall part, the first driven gear body including a first large-diameter driven gear meshing with the pinion gear; and the built-in cover is provided in a circulation shape without a break by continuation of the first peripheral wall part and the second peripheral wall part.

4 Claims, 6 Drawing Sheets

(56) References Cited

U.S. PATENT DOCUMENTS

| | | | | |
|---|---|---|---|---|
| 3,894,720 | A | 7/1975 | Koji | |
| 5,125,629 | A * | 6/1992 | Nishimura | B66D 3/16<br>254/358 |
| 2013/0023107 | A1 | 1/2013 | Martin et al. | |
| 2013/0233107 | A1* | 9/2013 | Von Wilmowsky | F16H 57/027<br>74/421 R |

FOREIGN PATENT DOCUMENTS

| | | | |
|---|---|---|---|
| CN | 202251857 | U | 5/2012 |
| CN | 104495674 | A | 4/2015 |
| JP | 02008956 | Y2 | 3/1990 |
| JP | 05009358 | B2 | 2/1993 |
| JP | 05083525 | U | 11/1993 |
| JP | 07048093 | | 2/1995 |
| JP | 5227808 | Y2 | 7/2013 |
| JP | 2013539529 | A | 10/2013 |
| JP | 5608000 | B2 | 9/2014 |
| WO | 2012028231 | A1 | 3/2012 |

OTHER PUBLICATIONS

Extended European Search Report corresponding to Application No. PCT/JP2016/083343; dated Feb. 14, 2017.

* cited by examiner

CHAIN BLOCK AND BUILT-IN COVER

CROSS REFERENCE TO RELATED APPLICATIONS

This is a U.S. national stage of application No. PCT/JP2016/083343, filed on Nov. 10, 2016. Priority under 35 U.S.C.§ 119(a) and 35 U.S.C.§ 365(b) is claimed from Japanese Patent Applications No. 2015-221983 filed on Nov. 12, 2015, the disclosure of which is also incorporated herein by reference.

TECHNICAL FIELD

The present invention relates to a chain block used for work of discharging a cargo and to a built-in cover built in the chain block.

BACKGROUND ART

An electric chain block that moves up and down a load utilizing the driving force of a motor has a built-in gear unit including a plurality of gears, and the driving force is transmitted via the gear unit to a load sheave. For example, as disclosed in PTL 1, the gear unit is generally housed in a case. PTL 1 discloses a configuration that the gear unit is covered by a cover integrally formed with a gear case to prevent lack of lubricating oil around the gears.

CITATION LIST

Patent Literature

{PTL 1} Japanese Laid-Open Patent Application Publication No. 07-048093

SUMMARY OF INVENTION

Technical Problem

As described above, in the configuration disclosed in PTL 1, the gear unit is covered by the cover integrally formed with the gear case to suppress scattering of liquid lubricating oil in a wide range to thereby achieve prevention of the lack of lubricating oil. However, in the case of employing such a configuration, if the gear ratio or the gear configuration is changed, the gap between the cover and the gear changes. This reduces the effect of preventing the lubricating oil from scattering to the surroundings, easily causing occurrence of lack of lubricating oil.

It is also conceivable to produce a gear case in a new configuration every time when the gear ratio or the gear configuration is changed, in order to prevent the lack of lubricating oil. However, in this case, it is necessary to change the facility for forming the gear case, for example, a metal mold for die-casting, unfavorably leading to increased cost.

Note that in the gear unit configured by combining a plurality of gears overlapped, it is often difficult to integrally form a cover with the gear case in a manner not to obstruct its assembly performance, the cover being effectively preventing scattering of the lubricating oil.

Besides, an example of changing the gear configuration is a case in which a load gear with a larger diameter is arranged to be coaxial with a pinion gear. In this case, the pinion gear is set to be located not at a position closer to an outer wall of the gear case as disclosed in PTL 1, but at a relatively center side of the gear case in order to make the gear case compact. A problem in such a case is that particularly the pinion gear is apt to lack lubricating oil, leading to a decrease in life of the chain block. This tendency becomes conspicuous, in particular, in the gears rotated at high speed including the pinion gear.

In particular, for some electric chain blocks, employment of not the liquid lubricating oil but grease is under consideration in order to facilitate maintenance. Also the electric chain block of such type is desirably configured to be able to re-supply the grease to the gears rotated at high speed including the pinion gear.

The present invention has been made in consideration of the above circumstances, and its object is to provide, without obstructing assembly performance of a gear unit, a chain block and a built-in cover which are capable of relatively easily preventing lack of lubricating oil even in a case where a gear ratio or a gear configuration is changed and in a case with gears rotated at high speed.

Solution to Problem

To solve the above problem, according to a first aspect of the present invention, there is a provided a chain block configured to move up and down a load via a chain wound around a load sheave member, by transmitting driving force generated by a motor unit to the load sheave member, the chain block including: a gear unit including a pinion gear configured to transmit the driving force generated by the motor unit, and a load gear coaxially and rotatably attached to the pinion gear and configured to rotate integrally with the load sheave member; a case body configured to house the gear unit and to be supplied with grease being semifluid or semisolid at a working temperature as a lubricant; and a built-in cover provided separately from the case body and arranged inside the case body, wherein: the built-in cover includes a first peripheral wall part configured to cover an outer peripheral side of the pinion gear, and a second peripheral wall part provided to be larger in diameter than the first peripheral wall part by covering a periphery of a first driven gear body, the first driven gear body including a first large-diameter driven gear meshing with the pinion gear and being larger in diameter than the pinion gear; and the built-in cover is provided in a circulation shape without a break by continuation of the first peripheral wall part and the second peripheral wall part.

Besides, in another aspect of the present invention, it is preferable in the above invention that the second peripheral wall part is formed with an opposed receiving part configured to be opposed to the first large-diameter driven gear while projecting toward a center side in a radial direction of the second peripheral wall part to hold the grease.

Besides, in another aspect of the present invention, it is preferable in the above invention that: the first driven gear body is provided with a first small-diameter driven gear coaxially and integrally with the first large-diameter driven gear; the gear unit is provided with a second driven gear body, and the second driven gear body is provided with a second large-diameter driven gear meshing with the first small-diameter driven gear; the built-in cover is provided with a third peripheral wall part configured to cover an outer peripheral side of the second large-diameter driven gear; and the third peripheral wall part is provided to be continuous with the first peripheral wall part and with the second peripheral wall part to provide the built-in cover in a circulation shape without a break.

Besides, according to a second aspect of the present invention, there is a built-in cover used for a chain block, housed in a case body housing a gear unit including a plurality of gears for transmitting driving force generated by a motor unit to a load sheave member, and provided separately from the case body, the built-in cover including: a first peripheral wall part configured to cover an outer peripheral side of a pinion gear of the gear unit; and a second peripheral wall part provided to be larger in diameter than the first peripheral wall part by covering a periphery of a first driven gear body, the first driven gear body including a first large-diameter driven gear meshing with the pinion gear and being larger in diameter than the pinion gear, wherein the built-in cover is provided in a circulation shape without a break by continuation of the first peripheral wall part and the second peripheral wall part.

Besides, in another aspect of the present invention, it is preferable in the above invention that the second peripheral wall part is formed with an opposed receiving part configured to be opposed to the first large-diameter driven gear while projecting toward a center side in a radial direction of the second peripheral wall part to hold the grease.

Advantageous Effects of Invention

According to the present invention, it is possible to relatively easily prevent lack of lubricating oil even in a chain block having gears rotating at high speed.

DESCRIPTION OF EMBODIMENTS

Figure 1:
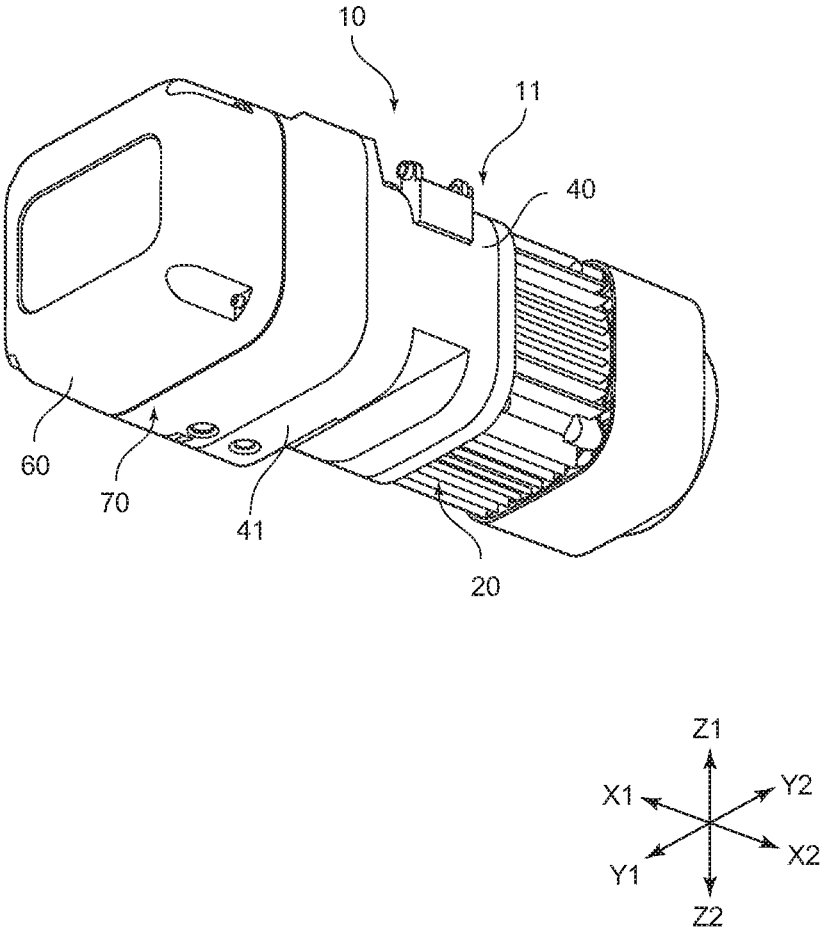
FIG. 1 is a perspective view illustrating the whole configuration of a main body of a chain block according to an embodiment of the present invention.

Hereinafter, a chain block 10 according to a first embodiment of the present invention will be described referring to the drawings. Note that in the following description, an explanation will be given using an XYZ orthogonal coordinate system as needed. An X-direction in the XYZ orthogonal coordinate system is assumed to be an axial direction of a load sheave member 50 in FIG. 2, and an X1 side indicates a lower light side in FIG. 2 and an X2 side indicates an upper left side opposite thereto. Further, a Z-direction indicates a direction in which the chain block 10 is suspended, and a Z1 side indicates a deep side of paper in FIG. 1 and FIG. 2 and a Z2 side indicates a near side of paper opposite thereto. Further, a Y-direction indicates a direction orthogonal to the X-direction and to the Z-direction, a Y1 side indicate an upper right side in FIG. 2 and a Y2 side indicates a lower left side opposite thereto.

The chain block 10 in this embodiment can employ one using method, namely a normal suspension, of moving up and down a load in a state where a main body is attached to an upper part, and additionally employ another using method, namely a reverse suspension, of moving up and down a main body together with a load in a state where a hook is hooked on an engaging portion at an upper part. The reverse suspension is preferable for work of lifting up and installing equipment for illumination and sound at a place where attachment of the main body is difficult, such as a stage, concert hall, event hall or the like.

<Regarding the Whole Configuration of the Chain Block 10>

Figure 2:
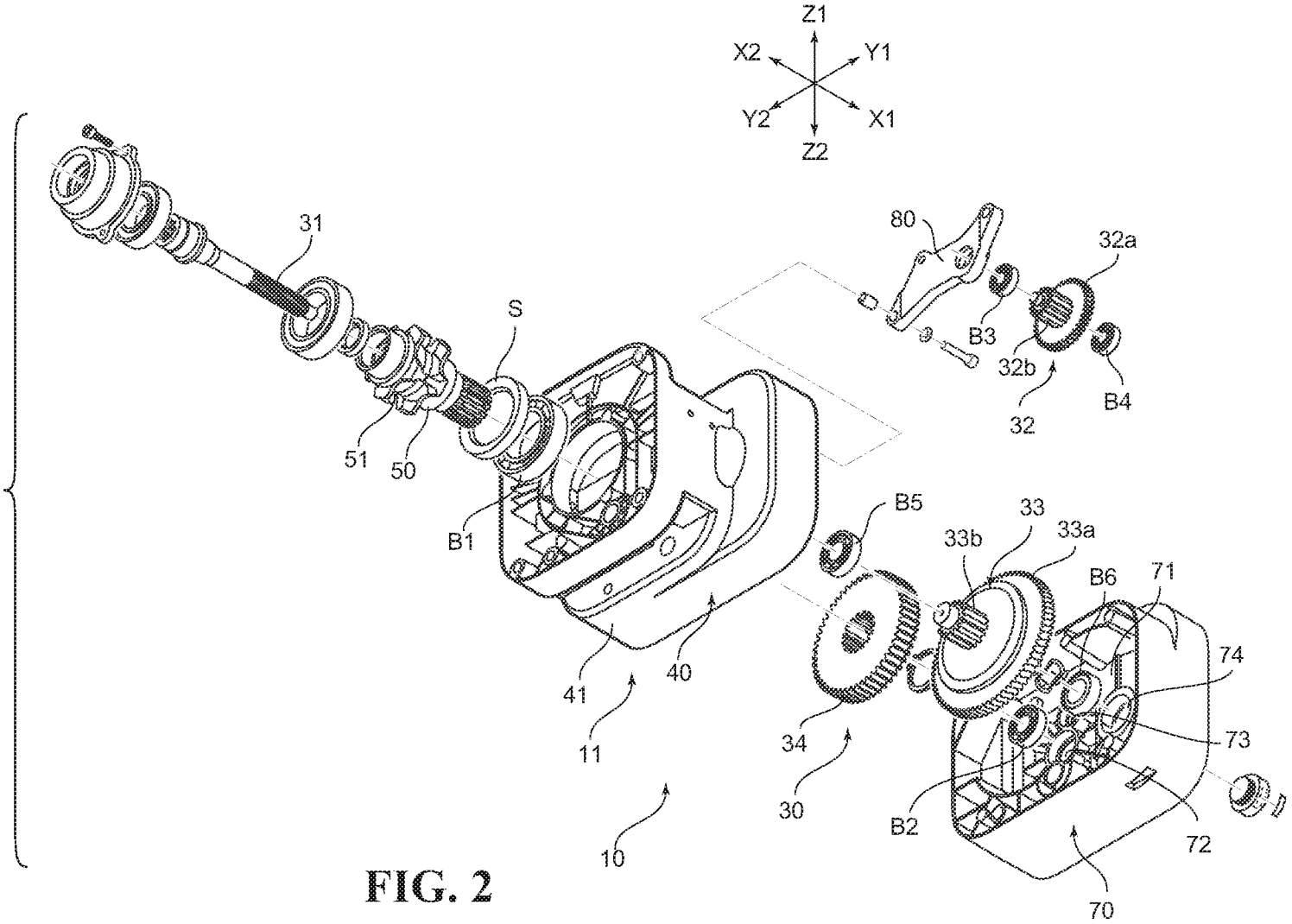
FIG. 2 is an exploded perspective view illustrating a configuration around a gear unit and a body of the chain block illustrated in FIG. 1.

FIG. 1 is a perspective view illustrating the whole configuration of a main body 11 of the chain block 10. FIG. 2 is an exploded perspective view illustrating a configuration around a gear unit 30 and a body 40 of the chain block 10. As illustrated in FIG. 1 and FIG. 2, the chain block 10 includes a motor unit 20, the gear unit 30, the body 40, the load sheave member 50, a control unit 60 and so on.

In the chain block 10 illustrated in FIG. 1 and FIG. 2, the driving force from the motor unit 20 is transmitted to the gear unit 30, reduced in speed at a predetermined reduction gear ratio, and then transmitted to the load sheave member 50 arranged in the body 40 to rotate the load sheave member 50.

Here, around the load sheave member 50, a not-illustrated load chain is wound, and the load chain is hoisted and lowered to relatively change the distance between a not-illustrated hook and the main body 11. Under the above mentioned state, a load can be lifted up with respect to the main body 11 located above in the case of the normal suspension. Besides, the load can be lifted up together with the main body 11 in the case of the reverse suspension.

<Regarding Configurations of the Gear Unit 30, the Body 40, and a Gear Case 70>

Next, the gear unit 30 will be described. As illustrated in FIG. 2, the gear unit 30 includes a pinion gear 31, a first driven gear body 32, a second driven gear body 33, and a load gear 34. The pinion gear 31 is coupled to a motor shaft (not illustrated) of the motor unit 20. Further, the pinion gear 31 meshes with a first large-diameter driven gear 32*a* of the first driven gear body 32. The first driven gear body 32 is integrally and coaxially provided with a first small-diameter driven gear 32*b* smaller in number of teeth and in diameter than the first large-diameter driven gear 32*a*, in addition to the first large-diameter driven gear 32*a*.

Figure 4:
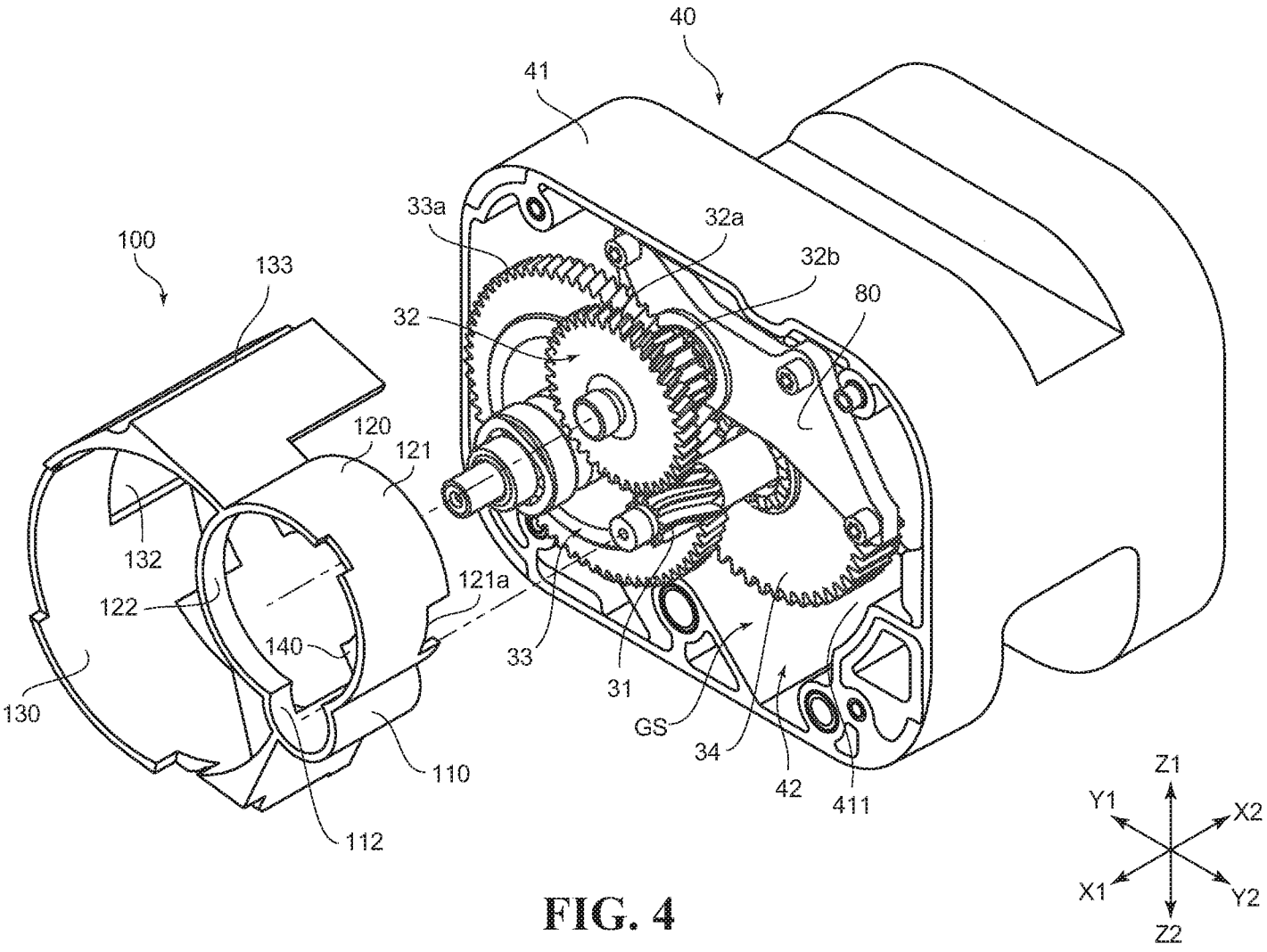
FIG. 4 is a perspective view illustrating a gear box part side of the body included in the chain block illustrated in FIG. 1, and a view illustrating a state where a built-in cover is detached.

A second large-diameter driven gear 33*a* of the second driven gear body 33 meshes with the first small-diameter driven gear 32*b* (see later-described FIG. 4 and FIG. 6). The second driven gear body 33 is integrally and coaxially provided with a second small-diameter driven gear 33*b* smaller in number of teeth and in diameter than the second large-diameter driven gear 33*a*, in addition to the second large-diameter driven gear 33*a*.

Note that the second driven gear body 33 may be configured such that the second large-diameter driven gear 33*a* and the second small-diameter driven gear 33*b* are rotated together at all times, but may be configured such that they are separately formed and combined together having a friction clutch incorporated between them. In this case, the second driven gear body 33 is configured to have a clutch friction plate, a disc spring or the like, so that upon occurrence of an overload state, the second large-diameter driven gear 33*a* side is rotated but the rotation thereof is not transmitted to the second small-diameter driven gear 33*b* side, which is made to slip, thereby preventing an overload and the hoisting more than specified.

Further, the second driven gear body 33 may be configured to have a function of a mechanical brake. In this case, a ratchet tooth (not illustrated) is coaxially attached in addition to the second large-diameter driven gear 33*a* and the second small-diameter driven gear 33*b*, and a claw member (not illustrated) for stopping rotation of the ratchet tooth in one direction while being pressed by a spring member is rotatably attached to a gear box part 41. This makes it possible to constitute a mechanical brake that permits a rotation in one direction and prevents unintended reverse rotation.

Further, the load gear 34 meshes with the second small-diameter driven gear 33*b*. The load gear 34 is provided to be coaxial with the pinion gear 31 in this embodiment. However, the rotation of the pinion gear 31 is not directly transmitted to the load gear 34. More specifically, the load gear 34 is spline-coupled to an end portion side of the load sheave member 50 having a hollow portion, whereby the load gear 34 and the load sheave member 50 integrally rotate. However, the pinion gear 31 is inserted through the hollow portion of the load sheave member 50, so that the load sheave member 50 and the pinion gear 31 are rotatable with respect to each other.

Through the gear unit 30 having the above configuration, the driving force generated at the motor unit 20 can be transmitted to the load sheave member 50.

Next, the body 40 and the gear case 70 will be described. The body 40 is a member formed, for example, by casting metal, and a chain wound part 51, around which the load chain is wound, of the load sheave member 50 is provided in the body 40. Further, the gear case 70 is also a member formed, for example, by casting metal similarly to the body 40.

Figure 3:
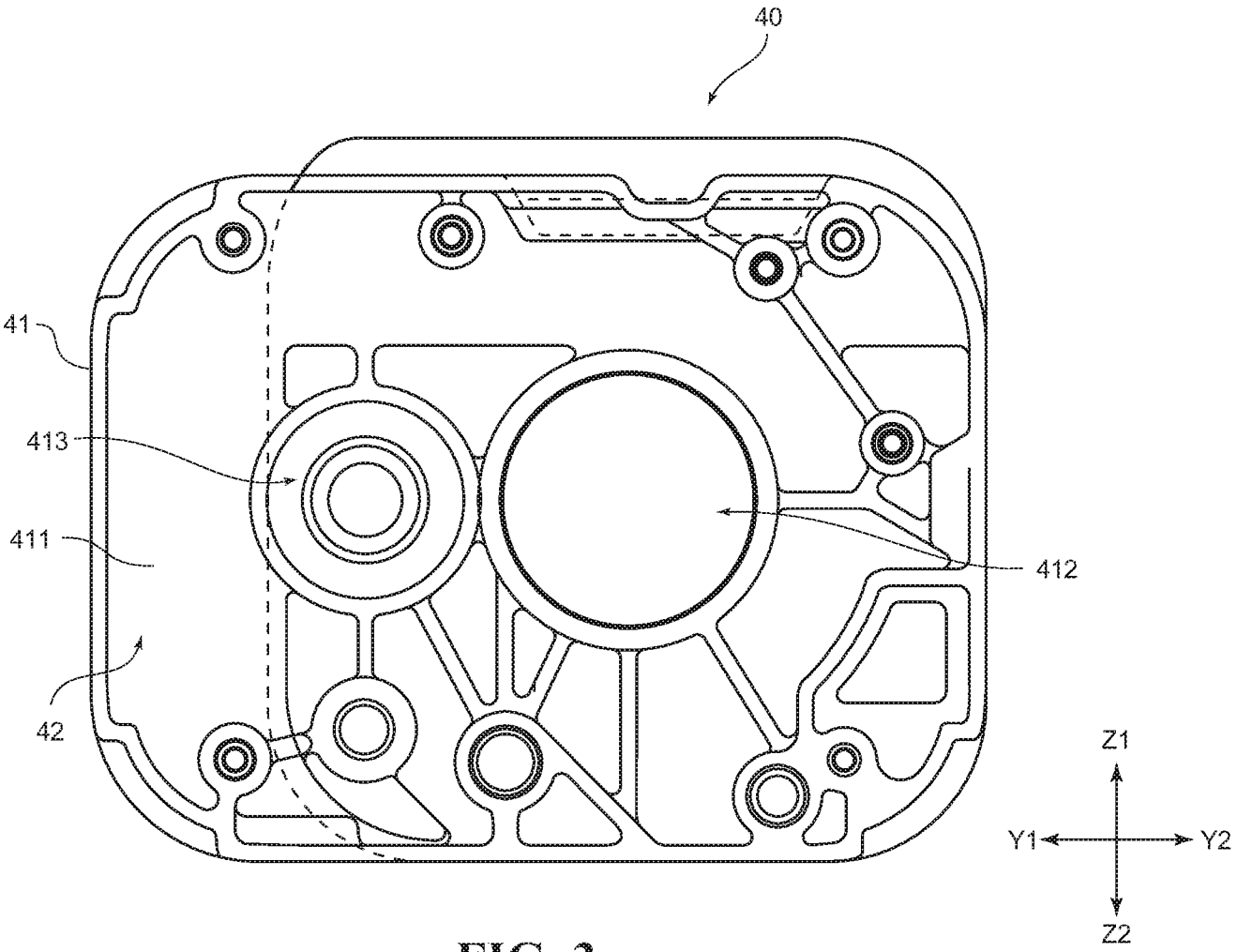
FIG. 3 is a plan view illustrating a side where a gear case is attached, of the body included in the chain block illustrated in FIG. 1.

FIG. 3 is a plan view illustrating a side (gear box part 41 side) where the gear case 70 is attached, of the body 40. FIG. 4 is a perspective view illustrating the gear box part 41 side of the body 40, and a view illustrating a state where a later-described built-in cover 100 is detached. As illustrated in FIG. 3 and FIG. 4, the body 40 is provided with the gear box part 41 in a recessed shape. Further, in an accommodating recessed part 42 of the gear box part 41, the above-described pinion gear 31, first driven gear body 32, second driven gear body 33, and load gear 34 are housed.

A bottom part 411 of the above-described gear box part 41 is provided with an insertion hole 412 penetrating the bottom part 411. Through the insertion hole 412, the pinion gear 31 and one end side (X1 side; gear case 70 side) of the load sheave member 50 project into the accommodating recessed part 42. Further, a bearing B1 is fitted in the insertion hole 412 to rotatably support the load sheave member 50. Further, an oil seal Si also fits in the insertion hole 412 and thereby prevents leakage of grease through the insertion hole 412, the grease being semifluid or semisolid at an operating temperature (about −20° to 240° C.) and being supplied into the accommodating recessed part 42. Note that in the accommodating recessed part 42, the pinion gear 31 is located closer to the one end side (X1 side) than is the load gear 34.

On the other hand, at a bottom part 71 of the gear case 70, a recessed fitting part 72 into which a bearing B2 is fitted is provided, and the one side of the pinion gear 31 is rotatably supported to be rotatable via the bearing B2.

Besides, the first driven gear body 32 is not directly supported on the gear box part 41. More specifically, on the motor unit 20 side in the accommodating recessed part 42, the load gear 34 is arranged so as to be coaxial with the pinion gear 31. Since the load gear 34 is larger in diameter than the pinion gear 31, the first driven gear body 32 cannot be rotatably supported on the bottom part 411 side of the gear box part 41 due to the existence of the load gear 34. Accordingly, on the lower side and on the left side in FIG. 3 of the end surface on the gear case 70 side of the gear box part 41, a support plate 80 for supporting the first driven gear body 32 is attached, for example, via screws or the like. Note that the support plate 80 is provided with a recessed fitting part into which a bearing B3 is fitted, and the other end side (X2 side) of the first driven gear body 32 is rotatably supported via the bearing B3.

Note that the one end side (X1 side) of the first driven gear body 32 is rotatably supported to be rotatable via a bearing B4 on the gear case 70 side, and the bearing B4 is fitted in a recessed fitting part 73 formed in the bottom part 71. This realizes a configuration that both end sides of the first driven gear body 32 are rotatably supported so as to be rotatable.

Besides, the other end side (X2 side) of the second driven gear body 33 is rotatably supported via a bearing B5 fitted in a recessed fitting part 413 (see FIG. 3) existing at the bottom part 411 of the gear box part 41. On the other hand, the one end side (X1 side) of the second driven gear body 33 is rotatably supported to be rotatable via a bearing B6 fitted in a recessed fitting part 74 existing at the bottom part 71 of the gear case 70.

The gear unit 30 having the above configuration is housed in the accommodating recessed part 42 of the gear box part 41. Further, the gear box part 41 and the gear case 70 are attached, for example, via bolts or the like in a state where a not-illustrated packing arranged between them. Thus, between the gear box part 41 and the gear case 70, a gear accommodating space GS including the accommodating recessed part 42 is formed. Note that the gear box part 41 and the gear case 70 correspond to a case body, but any one of them may be made to correspond to the case body.

<Regarding the Built-In Cover 100>

Figure 5:
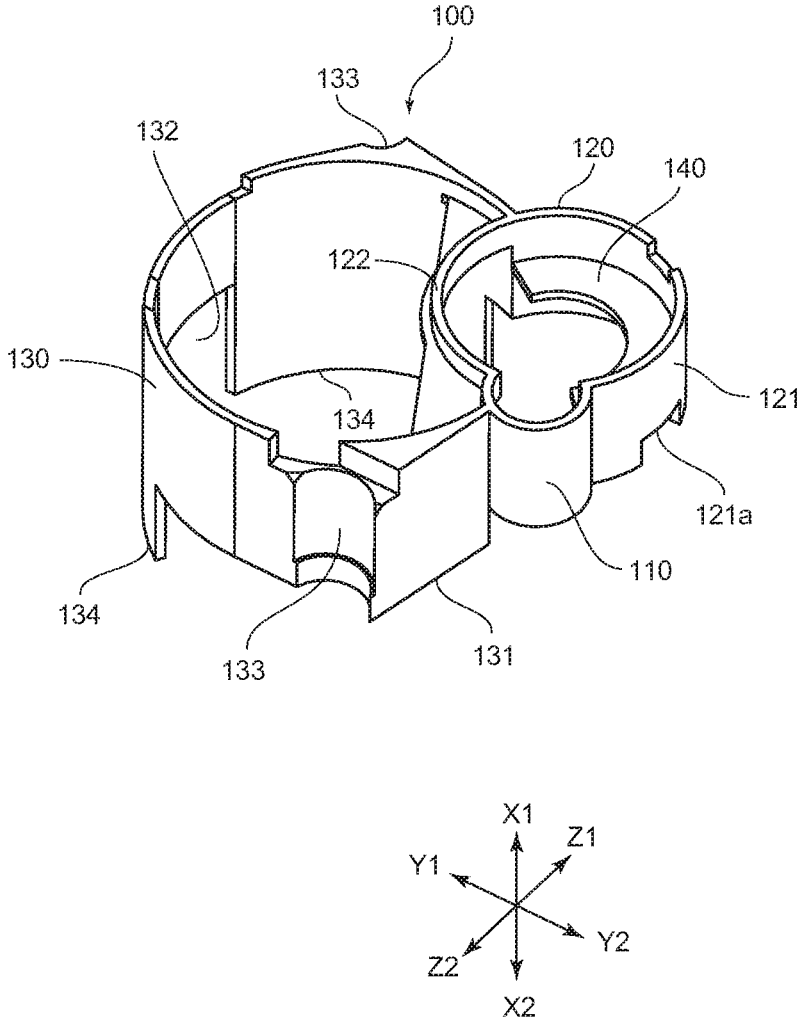
FIG. 5 is a perspective view illustrating a configuration of the built-in cover according to an embodiment of the present invention.

In the above-described gear accommodating space GS, the built-in cover 100 is arranged. Hereinafter, the built-in cover 100 will be described. FIG. 5 is a perspective view illustrating a configuration of the built-in cover 100. FIG. 6 is a plan view illustrating a state where the built-in cover 100 is attached to the gear box part 41.

Figure 6:
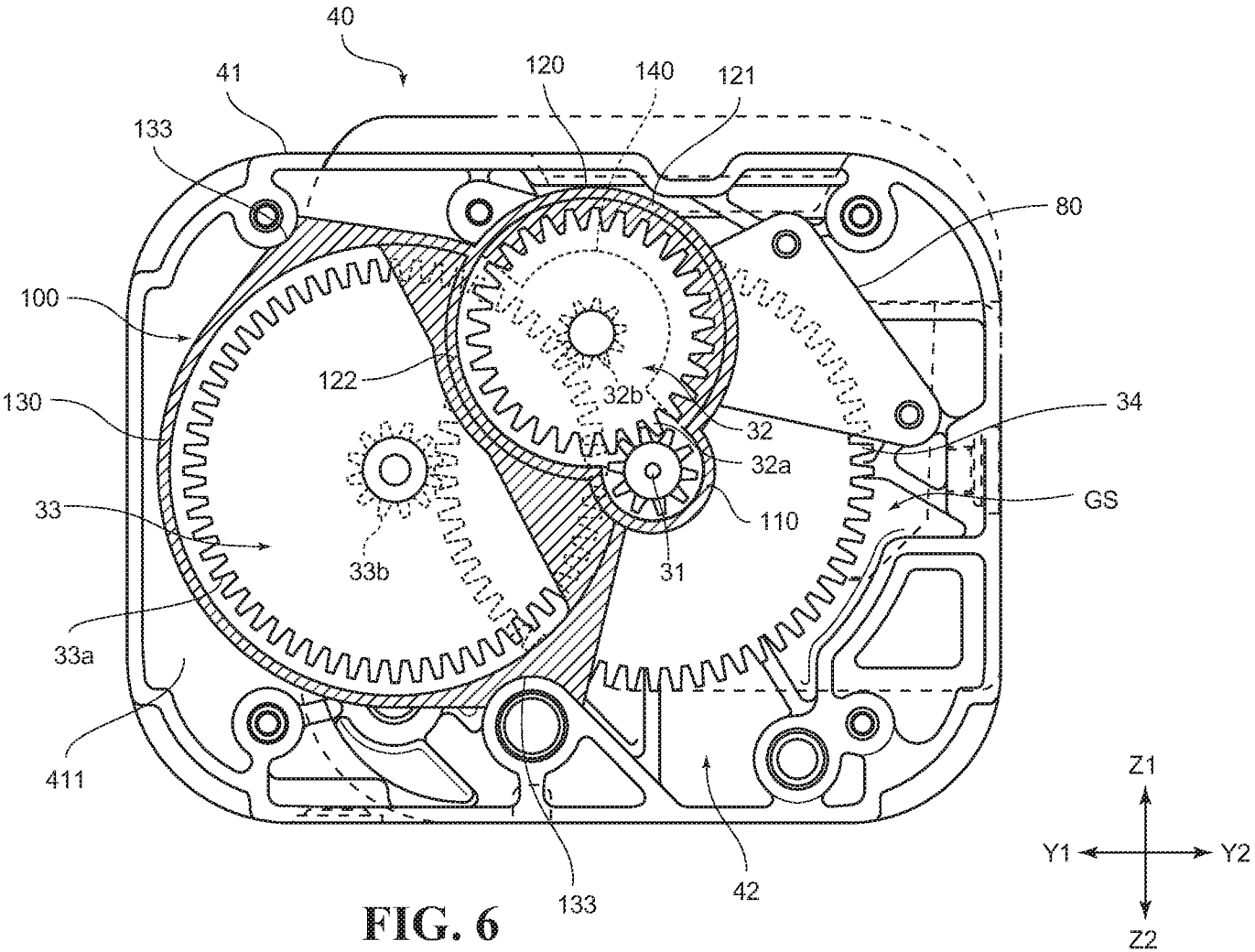
FIG. 6 is a plan view illustrating a state where the built-in cover illustrated in FIG. 5 is attached to the gear box part.

As illustrated in FIG. 6, the built-in cover 100 is a member that covers the periphery of the gear unit 30 excluding the load gear 34. The built-in cover 100 is formed of a rubber material, for example, nitrile rubber having oil resistance and slight elasticity. Note that the material of the built-in cover 100 is not limited to nitrile rubber, but another rubber-based material such as styrene butadiene rubber (SBR), fluorine rubber, chloroprene rubber (CR), silicone rubber, epichlorohydrin rubber, acrylic rubber, or urethane rubber, or a synthetic resin may be used. Note that use of the rubber material having elasticity at a certain degree facilitates assembly and holding of the rubber material in the box and can also contribute to prevention of sound generated from the gear and the like.

As illustrated in FIG. 5 and FIG. 6, the built-in cover 100 is provided in a state where three peripheral wall parts in total are continued. Mores specifically, the built-in cover 100 is provided with a first peripheral wall part 110, a second peripheral wall part 120, and a third peripheral wall part 130. In the built-in cover 100, an opposed receiving part 140 also exists in addition to the three peripheral wall parts 110, 120, 130.

The first peripheral wall part 110 is a portion covering the outer peripheral side of the pinion gear 31, and is provided to have a smallest diameter among the three peripheral wall parts 110, 120, 130. Further, as illustrated in FIG. 2, the pinion gear 31 is provided to have a relatively large length in the X-direction. Accordingly, the first peripheral wall part 110 covering the outer peripheral side of the pinion gear 31 is provided to have a relatively large dimension in a depth direction in FIG. 5 and FIG. 6 (X-direction in FIG. 2). However, the height of the first peripheral wall part 110 is provided to be smaller than the height of the third peripheral wall part 130.

In this embodiment, the first peripheral wall part 110 is opposed to the outer periphery of the pinion gear 31 with a gap of, for example, about 2 mm intervening therebetween. Accordingly, even if the pinion gear 31 is rotated and the grease is scattered to the outer peripheral side due to the centrifugal force thereof, the first peripheral wall part 110 can catch the scattered grease. Therefore, it is possible to reduce occurrence of lack of grease.

Note that the gap between the pinion gear 31 and the first peripheral wall part 110 is not limited to about 2 mm, but can be variously set within a range capable of effectively preventing lack of grease, such as within a range of, for example, 1 mm to 5 mm.

Besides, the second peripheral wall part 120 is a portion covering the outer peripheral side of the first driven gear body 32. The second peripheral wall part 120 is provided to continue to the first peripheral wall part 110. More specifically, since a peripheral wall part, if existing at a portion where the first peripheral wall part 110 and the second peripheral wall part 120 intersect with each other, is an obstacle to mesh between the pinion gear 31 and the first large-diameter driven gear 32*a*, no peripheral wall part exists at the intersection portion. Therefore, in a plan view of the first peripheral wall part 110 and the second peripheral wall part 120, their appearance is provided in an almost gourd shape in which a large-diameter circle and a small-diameter circle continue.

Further, the second peripheral wall part 120 is opposed to the outer periphery of the first driven gear body 32 (first large-diameter driven gear 32*a*) with a gap of, for example, about 2 mm intervening therebetween. Accordingly, even if the grease is scattered to the outer peripheral side due to the rotation of the first driven gear body 32 (first large-diameter driven gear 32*a*), the second peripheral wall part 120 can catch the grease. Therefore, it is possible to reduce occurrence of lack of grease also on the outer peripheral side of the first driven gear body 32 (first large-diameter driven gear 32*a*).

Note that also the gap between the first large-diameter driven gear 32*a* and the second peripheral wall part 120 is not limited to about 2 mm. The gap can be variously set within a range capable of effectively preventing lack of grease, such as within a range of, for example, 1 mm to 5 mm.

Here, the second peripheral wall part 120 is provided with an outer peripheral wall part 121 existing on a side not adjacent to the third peripheral wall part 130, and with an inner peripheral wall part 122 existing at a portion adjacent to the third peripheral wall part 130. The outer peripheral wall part 121 is provided at the same level as the height (depth) of the above-described first peripheral wall part 110. The outer peripheral wall part 121 is supported on the above-described support plate 80 at the deep side (X2 side).

Note that the outer peripheral wall part 121 is provided with a positioning recessed part 121*a* for positioning. The positioning recessed part 121*a* is a portion recessed by a predetermined amount to be directed from the deep side (X2 side) to an open side (X1 side) of the outer peripheral wall part 121. The support plate 80 is located in the positioning recessed part 121*a* so as to position the built-in cover 100 with respect to the support plate 80. Further, at a portion where the support plate 80 is not located in the circumferential direction of the outer peripheral wall part 121, the outer peripheral wall part 121 can be located at a deeper side (X2 side) than is the support plate 80, and can effectively prevent lack of grease.

On the other hand, the inner peripheral wall part 122 is provided to have a dimension in the depth direction significantly smaller than that of the outer peripheral wall part 121. This is because the second large-diameter driven gear 33*a* of the second driven gear body 33 is located on the lower side of the inner peripheral wall part 122. Accordingly, the inner peripheral wall part 122 is provided in an arc shape having a small dimension in the depth direction so as to connect (bridge) the first peripheral wall part 110 and the outer peripheral wall part 121.

Note that the inner peripheral wall part 122 exists not only in the second peripheral wall part 120 but also in the first peripheral wall part 110 (hereinafter, the inner peripheral wall part in the first peripheral wall part 110 is an inner peripheral wall part 112).

Besides, the third peripheral wall part 130 is a portion covering the outer peripheral side of the second driven gear body 33. The second driven gear body 33 is provided with the second large-diameter driven gear 33*a* having a diameter larger than those of the pinion gear 31 and the first large-diameter driven gear 32*a*. Accordingly, the third peripheral wall part 130 is provided to have a diameter larger than those of the first peripheral wall part 110 and the second peripheral wall part 120.

The third peripheral wall part 130 is provided with a gear recessed part 131 for preventing interference with the load gear 34. However, the load gear 34 is provided to be located at a deeper side (X2 side; bottom part 411 side) of the accommodating recessed part 42 than is the second large-diameter driven gear 33*a* of the second driven gear body 33. Therefore, the dimension in the depth direction (X-direction) of the third peripheral wall part 130 is provided to be larger than the dimensions in the depth direction of the first peripheral wall part 110 and the second peripheral wall part 120, also at a portion where the gear recessed part 131 exists.

Further, the third peripheral wall part 130 is opposed to the outer periphery of the second driven gear body 33 (second large-diameter driven gear 33*a*) with a predetermined gap intervening therebetween. This gap can be set to be larger than the gap between the first driven gear body 32 (first large-diameter driven gear 32*a*) and the second peripheral wall part 120 such as about 5 mm in consideration that the first large-diameter driven gear 32*a* has a diameter larger than that of the second large-diameter driven gear 33*a*. However, the gap between the second driven gear body 33 (second large-diameter driven gear 33*a*) and the third peripheral wall part 130 may be set to the same amount as the gap between the first driven gear body 32 (first large-diameter driven gear 32*a*) and the second peripheral wall part 120.

Note that the gap between the second driven gear body 33 (second large-diameter driven gear 33*a*) and the third peripheral wall part 130 is not limited to about 5 mm. The gap can be variously set within a range capable of effectively preventing lack of grease, such as within a range of, for example, 1 mm to 10 mm.

Further, the third peripheral wall part 130 is also provided with an outer peripheral recessed part 132 for escaping from a rib, a boss or the like of the gear box part 41. Further, the third peripheral wall part 130 is provided with fitting recessed parts 133. The fitting recessed part 133 is a portion for fitting with the boss or the like of the gear box part 41 to position the built-in cover 100, and is provided to be long in the depth direction (X-direction). As illustrated in FIG. 5 and FIG. 6, the built-in cover 100 in this embodiment is provided with two fitting recessed parts 133 in total. However, the number of the fitting recessed parts 133 to be provided may be arbitrarily set according to the boss and the like of the gear box part 41.

Note that bump parts 134, the fitting recessed parts 133, the positioning recessed part 121*a*, and the gear case 70 press down the built-in cover 100 inside the gear accommodating space GS. Accordingly, the built-in cover 100 can be fixed in the gear accommodating space GS without a screw or the like.

Further, the third peripheral wall part 130 is provided with the bump parts 134. The bump part 134 is a portion that abuts against the bottom part 411 of the gear box part 41 and thereby decides the position in the height direction of the built-in cover 100 in the recessed fitting part 42. In this embodiment, the bump parts 134 are provided at two locations in the circumferential direction of the third peripheral wall part 130, but the number of the bump parts 134 may be arbitrarily set.

Further, the built-in cover 100 is also provided with the opposed receiving part 140. As illustrated in FIG. 5 and FIG. 6, the opposed receiving part 140 projects from the inner wall of the second peripheral wall part 120 toward the center in the radial direction, and has an appearance in an arc shape. The opposed receiving part 140 is provided to be opposed to the lower surface (surface on the deep side) of the first large-diameter driven gear 32*a*. Accordingly, the opposed receiving part 140 is also opposed almost parallel to the bottom part 411, but does have to be almost parallel to the bottom part 411. The opposed receiving part 140 is preferably provided as long as possible, and is therefore provided to reach the boundary of the inner peripheral wall part 122 from the boundary of the first peripheral wall part 110, of the inner wall of the outer peripheral wall part 121 of the second peripheral wall part 120.

The opposed receiving part 140 is opposed to the lower surface (surface on the deep side) of the first large-diameter driven gear 32*a* with a gap of about 2 mm intervening therebetween. However, the gap between the lower surface of the first large-diameter driven gear 32*a* and the opposed receiving part 140 is not limited to about 2 mm, but can be variously set within a range capable of effectively preventing lack of grease, such as within a range of, for example, 1 mm to 10 mm.

Further, the inner peripheral wall part of the opposed receiving part 140 is opposed to the first small-diameter driven gear 32*b* of the first driven gear body 32. Further, the end portions in the circumferential direction of the opposed receiving part 140 are opposed to the pinion gear 31 and the second large-diameter driven gear 33*a* respectively. The gap between them is about 2 mm as described above in some cases, but is not limited to about 2 mm and can be variously set within a range capable of effectively preventing lack of grease, such as within a range of, for example, 1 mm to 10 mm.

The above-described built-in cover 100 is attached to the accommodating recessed part 42.

Note that the gear unit 30 is being supplied with grease. The grease is high in viscosity than oil being liquid and is inferior in flowability. Therefore, the grease is semisolid or semifluid at an operating temperature. Note that to prevent the grease from flowing to the outside in a state where the grease is supplied to the gear unit 30, the packing intervenes between the gear case 70 and the body 40 (gear box part 41). In other words, the body 40 (gear box part 41) and the gear case 70 are fixed to each other with screws or the like with the packing intervening between them.

<Regarding Behavior of the Gear Unit 30 When the Built-In Cover 100 is Attached>

Next, the behavior of the gear unit 30 in the case where the built-in cover 100 is attached in the gear accommodating space GS will be described. In the case where the main body 11 is attached in a reverse suspension state, when the motor unit 20 drives, the driving force is transmitted via the gear unit 30 to the load sheave member 50 and thereby winds up the load chain to move up and down the main body 11 together with the load.

The pinion gear 31 is coupled to the motor shaft here, so that when the motor unit 20 drives, the pinion gear 31 is rotated at the same number of rotations as that of the motor shaft. Accordingly, the pinion gear 31 is brought into a state of rotating at high speed. Therefore, even if grease adheres to the pinion gear 31, the grease is apt to be scattered to the outer peripheral side by the centrifugal force at the time when the pinion gear 31 is rotated.

However, in this embodiment, the first peripheral wall part 110 is provided around the outer peripheral side of the pinion gear 31. Accordingly, the first peripheral wall part 110 can catch the grease scattered by the centrifugal force at the time of rotation, and can bounce the grease back toward the pinion gear 31. Therefore, the grease is held in the vicinity on the outer peripheral side of the pinion gear 31 and the grease is supplied again to the pinion gear 31.

Note that in the reverse suspension state, the first peripheral wall part 110 is preferably located on the lower side in the vertical direction than is the second peripheral wall part 120. In this case, the grease moves by gravity from the second peripheral wall part 120 side to the first peripheral wall part 110 side. This is because when the pinion gear 31 is rotated at high speed in a state where the grease is stored at the first peripheral wall part 110, meshing of the pinion gear 31 with the first large-diameter driven gear 32*a* or the like makes it possible to relatively easily supply the grease to the gears including the first large-diameter driven gear 32*a*.

Further, the pinion gear 31 meshes with the first large-diameter driven gear 32*a*, and around the outer peripheral side of the first large-diameter driven gear 32*a*, the second peripheral wall part 120 is arranged. The first large-diameter driven gear 32*a* meshes with the pinion gear 31 and is larger in diameter than the pinion gear 31. Accordingly, the centrifugal force by the rotation of the first large-diameter driven gear 32*a* is relatively large. Therefore, the grease is apt to be scattered to the outer peripheral side by the centrifugal force at the time when the first large-diameter driven gear 32*a* is rotated.

However, around the outer peripheral side of the first large-diameter driven gear 32*a*, the second peripheral wall part 120 is provided. Accordingly, the second peripheral wall part 120 can catch the grease scattering by the centrifugal force at the time of rotation, and can bounce the grease back toward the first large-diameter driven gear 32*a*. Therefore, the grease is held in the vicinity on the outer peripheral side of the first large-diameter driven gear 32*a* and the grease is supplied again to the first large-diameter driven gear 32*a*. Note that when grease adheres to the first large-diameter driven gear 32*a*, the grease is supplied also to the first small-diameter driven gear 32*b* along the outer peripheral surface or the like of the first large-diameter driven gear 32*a* and the grease is supplied also to the pinion gear 31.

Here, the surface on the deep side of the first large-diameter driven gear 32*a* is opposed to the opposed receiving part 140. Accordingly, the grease trying to move from the surface on the deep side of the first large-diameter driven gear 32*a* can be caught by the opposed receiving part 140 and held at the opposed receiving part 140. Note that a part of the load gear 34 extends to or a part of the pinion gear 31 extends to a portion where the opposed receiving part 140 does not exist on the inner peripheral side of the second peripheral wall part 120. Therefore, at the portion where the opposed receiving part 140 does not exist, the grease adheres to the load gear 34 and the pinion gear 31, whereby recirculation of the grease is achieved.

Further, the first small-diameter driven gear 32*b* of the first driven gear body 32 meshes with the second large-diameter driven gear 33*a* of the second driven gear body 33. Further, around the outer peripheral side of the second large-diameter driven gear 33*a*, the third peripheral wall part 130 is arranged. Generally, the rotation speed of the second large-diameter driven gear 33*a* is significantly lower than that of the pinion gear 31. Therefore, the centrifugal force at the second large-diameter driven gear 33*a* is decreased, but the grease adhering to the second large-diameter driven gear 33*a* is apt to move to the outer peripheral side more than at the time of no rotation. Further, the second large-diameter driven gear 33*a* is rotated at a rotation speed to scatter the grease by the centrifugal force in some cases depending on the gear ratio.

Accordingly, the third peripheral wall part 130 can catch the grease scattered and moved to the outer peripheral side by the centrifugal force at the time of rotation of the second large-diameter driven gear 33*a*, and can bounce the grease (though a smaller amount of grease as compared with those by the first peripheral wall part 110 and the second peripheral wall part 120) back toward the second large-diameter driven gear 33*a*. Therefore, the grease can be held in the vicinity on the outer peripheral side of the second large-diameter driven gear 33*a* and the grease can be supplied again to the second large-diameter driven gear 33*a*.

Note that when grease adheres to the second large-diameter driven gear 33*a*, the grease is brought into a state of being supplied also to the second small-diameter driven gear 33*b* along the outer peripheral surface or the like of the second large-diameter driven gear 33*a*. Further, the grease is supplied also to the load gear 34 via the second small-diameter driven gear 33*b* or the like, and the grease is supplied also to the first small-diameter driven gear 32*b*.

Here, it has been confirmed in an experiment that the difference in life due to lack of grease between the chain block 10 in this embodiment and the conventional chain block in which the built-in cover 100 is not arranged in the accommodating recessed part 42, is at least twice or more. Note that the above-described difference in life of twice or more includes a case of five times or more, and also includes 10 times or more.

<Regarding Effects>

According to the chain block 10 and built-in cover 100 with the above configurations, the built-in cover 100, provided separately from the gear box part 41 which accommodates the gear unit 30 and is supplied with the grease being semifluid or semisolid at the temperature (operating temperature) during operation of the chain block 10 as a lubricant, is arranged inside the accommodating recessed part 42 of the gear box part 41. The built-in cover 100 includes the first peripheral wall part 110 that covers the outer peripheral side of the pinion gear 31, and the second peripheral wall part 120 that is provided to be larger in diameter than the first peripheral wall part 110 by covering the periphery of the first driven gear body 32 including the first large-diameter driven gear 32*a* which meshes with the pinion gear 31 and is larger in diameter than the pinion gear 31. In addition, the built-in cover 100 is provided in a circulation shape without a break, by continuation of the first peripheral wall part 110 and the second peripheral wall part 120.

Here, since the pinion gear 31 and the load gear 34 are arranged to be coaxial as in this embodiment, the pinion gear 31 is located not at a portion closer to the outer wall portion of the gear box part 41 but at a portion relatively closer to the center of the gear box part 41. Therefore, at the pinion gear 31 rotated at high speed, the grease is likely to be scattered toward the outer peripheral wall, causing a state where lack of grease is likely to occur.

However, in this embodiment, since the first peripheral wall part 110 covers the periphery of the pinion gear 31, the first peripheral wall part 110 can catch the grease scattered from the pinion gear 31 toward the outer peripheral side, and can bounce the grease back toward the pinion gear 31. Therefore, it is possible to suppress occurrence of lack of grease at the pinion gear 31, thereby increasing the life of the chain block 10 and decreasing the frequency of maintenance.

Note that there is a secondary effect capable of decreasing the used amount of grease relatively expensive by providing the built-in cover 100 to suppress the scattered amount of grease.

Further, also at the first large-diameter driven gear 32*a*, the grease adhering to the first large-diameter driven gear 32*a* is scattered to the outer peripheral side by the centrifugal force at the time when the first large-diameter driven gear 32*a* is rotated, and the second peripheral wall part 120 can catch the scattered grease and bounce the grease back toward the first large-diameter driven gear 32*a*.

Further, the first peripheral wall part 110 and the second peripheral wall part 120 are formed in a circulation shape without a break. Here, in the case where the circulation shape has a break, the grease possibly flows out through the break portion to a further outer peripheral side, but the above circulation shape enables circulation of the grease adhering to the first peripheral wall part 110 and the second peripheral wall part 120. Accordingly, it is possible to effectively prevent lack of grease at the pinion gear 31 and at the first large-diameter driven gear 32*a* (first driven gear body 32), thereby increasing the life of the chain block 10.

Further, in this embodiment, even if the gear ratio or the gear configuration is changed, it is unnecessary to change the body 40 and the gear case 70. Therefore, it is unnecessary to produce relatively large-size metal molds for casting the body 40 and the gear case 70. Therefore, an increase in cost can be prevented accordingly.

Further, in this embodiment, on the inner peripheral side of the second peripheral wall part 120, the opposed receiving part 140 is provided which projects toward the center side in the radial direction of the second peripheral wall part 120. Further, the opposed receiving part 140 is opposed to the first large-diameter driven gear 32*a* so that the grease can be held at the opposed receiving part 140. Therefore, when the grease moves from the deep side (X2 side) of the first large-diameter driven gear 32*a* to a deeper side (X2 side), the opposed receiving part 140 can catch and hold the grease. Accordingly, it is possible to further effectively prevent occurrence of lack of grease at the first large-diameter driven gear 32*a*. Further, since the gap between the first large-diameter driven gear 32*a* and the load gear 34 is narrowed, thereby making it possible to prevent occurrence of lack of grease without grease being supplied to the first large-diameter driven gear 32*a* and the load gear 34 due to storage of the grease at an excessive gap. This enables further increase the life of the chain block 10.

Further, the built-in cover 100 is provided separately from the body 40 and the gear case 70. Accordingly, the built-in cover 100 does not obstruct the assembly performance of the gear unit 30 made by incorporating the gears. More specifically, the gear unit 30 is made by assembling the load gear 34, then assembling the second driven gear body 33, thereafter attaching the built-in cover 100 as a separate body to the accommodating recessed part 42, and finally assembling the first driven gear body 32. Therefore, the built-in cover 100 never obstructs the assembly performance of the gear unit 30.

Further, in this embodiment, the first driven gear body 32 is provided with the first small-diameter driven gear 32*b* coaxially and integrally with the first large-diameter driven gear 32*a*. Further, the gear unit 30 also includes the second driven gear body 33, and the second driven gear body 33 is provided with the second large-diameter driven gear 33*a* meshing with the first small-diameter driven gear 32*b*. Further, the built-in cover 100 is provided with the third peripheral wall part 130 that covers the outer peripheral side of the second large-diameter driven gear 33*a*, and the third peripheral wall part 130 is provided to be continuous with the first peripheral wall part 110 and with the second peripheral wall part 120 so as to provide the built-in cover 100 in a circulation shape without a break.

Therefore, even if the grease adhering to the second large-diameter driven gear 33*a* is scattered and moved to the outer peripheral side due to the rotation of the second large-diameter driven gear 33*a*, the third peripheral wall part 130 can catch the grease and can bounce the grease back toward the second large-diameter driven gear 33*a*. In addition, the third peripheral wall part 130 is continuous with the first peripheral wall part 110 and the second peripheral wall part 120, so that the built-in cover 100 is provided in a circulation shape without a break as a whole. Therefore, the grease adhering to the third peripheral wall part 130 can be made to circulate toward the first peripheral wall part 110 and the second peripheral wall part 120. Accordingly, the life of the chain block 10 can be further increased.

Further, in this embodiment, the built-in cover 100 is formed of a rubber material. In this case, the noise generated by the gear unit 30 can be reduced to improve the quietness of the chain block 10. Further, since the built-in cover 100 is formed of a rubber material and can be attached while being elastically deformed, rattling of the built-in cover 100 in the gear housing space GS can be reduced. In addition, since the built-in cover 100 is formed of a rubber material having elasticity (flexibility), the built-in cover 100 is easily assembled.

MODIFICATION EXAMPLES

The embodiments of the present invention have been described above, and the present invention can be variously modified in addition to them. Hereinafter, they will be described.

In the above-described embodiment, the built-in cover 100 includes the third peripheral wall part 130 and the opposed receiving part 140 in addition to the first peripheral wall part 110 and the second peripheral wall part 120. However, the built-in cover 100 only needs to include at least the first peripheral wall part 110 and the second peripheral wall part 120 and may employ a configuration not including at least one of the third peripheral wall part 130 and the opposed receiving part 140.

Further, in the built-in cover 100 in the above embodiment may be additionally provided with a part similar to the opposed receiving part 140 as necessary in order to decrease gaps between gears, at the bottom part 411 of the gear box part 41, at the bottom part 71 of the gear case 70 and the like. In the case of this configuration, excessive gaps at respective portions can be reduced, and the scattered grease can be held and stored. Accordingly, it becomes possible to further prevent lack of grease in the chain block 10 to further increase the life of the chain block 10.

Further, in the above embodiment, the chain block 10 provided with the motor unit 20 is described. However, the built-in cover 100 of the present invention may be applied to a manual type chain block.

Further, in the above embodiment, the gear unit 30 is configured to include the pinion gear 31, the first driven gear body 32, the second driven gear body 33, and the load gear 34. However, the gear unit 30 is not limited to the configuration. For example, a configuration in which the second driven gear body 33 and the first driven gear body 32 are omitted may be employed. Further, a configuration in which another gear is additionally provided may be employed.

The invention claimed is:

1. A chain block configured to move up and down a load via a chain wound around a load sheave member, by transmitting driving force generated by a motor unit to the load sheave member, the chain block comprising:

a gear unit including a pinion gear configured to transmit the driving force generated by the motor unit, and a load gear coaxially and rotatably attached to the pinion gear and configured to rotate integrally with the load sheave member;

a case body configured to accommodate the gear unit and to be supplied with grease being semifluid or semisolid at an operating temperature as a lubricant; and a built-in cover provided separately from the case body and arranged inside the case body, wherein:

the built-in cover includes a first peripheral wall part configured to cover an outer peripheral side of the pinion gear, and a second peripheral wall part provided to be larger in diameter than the first peripheral wall part by covering a periphery of a first driven gear body, the first driven gear body including a first large-diameter driven gear meshing with the pinion gear and being larger in diameter than the pinion gear; and the built-in cover is provided in a continuation shape without a break by continuation of the first peripheral wall part and the second peripheral wall part.

2. The chain block according to claim 1, wherein the second peripheral wall part is formed with an opposed receiving part configured to be opposed to the first large-diameter driven gear while projecting toward a center side in a radial direction of the second peripheral wall part to hold the grease.

3. The chain block according to claim 2, wherein:

the first driven gear body is provided with a first small-diameter driven gear coaxially and integrally with the first large-diameter driven gear;

the gear unit is provided with a second driven gear body, and the second driven gear body is provided with a second large-diameter driven gear meshing with the first small-diameter driven gear;

the built-in cover is provided with a third peripheral wall part configured to cover an outer peripheral side of the second large-diameter driven gear; and the third peripheral wall part is provided to be continuous with the first peripheral wall part and with the second peripheral wall part to provide the built-in cover in a continuation shape without a break.

4. The chain block according to claim 1, wherein:

the first driven gear body is provided with a first small-diameter driven gear coaxially and integrally with the first large-diameter driven gear;

the gear unit is provided with a second driven gear body, and the second driven gear body is provided with a second large-diameter driven gear meshing with the first small-diameter driven gear;

the built-in cover is provided with a third peripheral wall part configured to cover an outer peripheral side of the second large-diameter driven gear; and the third peripheral wall part is provided to be continuous with the first peripheral wall part and with the second peripheral wall part to provide the built-in cover in a continuation shape without a break.

* * * * *